US009705222B2

(12) United States Patent
Ogihara

(10) Patent No.: US 9,705,222 B2
(45) Date of Patent: Jul. 11, 2017

(54) FEMALE TERMINAL WITH RESILIENT PIECE HAVING A CONTACT SURFACE THAT GRADUALLY NARROWS TO A CONTACT POINT

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Shigeru Ogihara, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 15/111,251

(22) PCT Filed: Jan. 19, 2015

(86) PCT No.: PCT/JP2015/051185
§ 371 (c)(1),
(2) Date: Jul. 13, 2016

(87) PCT Pub. No.: WO2015/118930
PCT Pub. Date: Aug. 13, 2015

(65) Prior Publication Data

US 2016/0329649 A1 Nov. 10, 2016

(30) Foreign Application Priority Data

Feb. 4, 2014 (JP) ..... 2014-019142

(51) Int. Cl.
*H01R 11/20* (2006.01)
*H01R 4/24* (2006.01)
(Continued)

(52) U.S. Cl.
CPC ..... *H01R 13/113* (2013.01); *H01R 4/023* (2013.01); *H01R 4/18* (2013.01)

(58) Field of Classification Search
CPC ..... H01R 13/113; H01R 13/11; H01R 4/18; H01R 4/023; H01R 4/02
(Continued)

(56) References Cited

U.S. PATENT DOCUMENTS 5,427,553 A 6/1995 Tsuji
5,735,717 A 4/1998 Nabeshima
(Continued)

FOREIGN PATENT DOCUMENTS

JP 6-9069 2/1994
JP 8-31490 2/1996
(Continued)

OTHER PUBLICATIONS

International Search Report.

*Primary Examiner* — Javaid Nasri
(74) *Attorney, Agent, or Firm* — Gerald E. Hespos; Michael J. Porco; Matthew T. Hespos

(57) ABSTRACT

A female terminal (10) includes a tubular portion (14) configured to receive a male terminal (11) therein. Resilient pieces (23, 26) extend in from a bottom wall (15) and a ceiling wall (17) of the tubular portion (14) and contact the male terminal (11). Each resilient piece (23, 26) includes a line-contact portion (29, 31) that slides in line or surface contact with the male terminal (11), a contact portion (25, 28) to contact the male terminal (11), and a gradually changing portion (30, 32) formed from an end (29B, 31B) of
(Continued)

the line-contact portion (29, 31) to a top (25A, 28A) of the contact portion (25, 28) and not protruding from a plane flush with a contact surface (29A, 31A) of the line-contact portion (29, 31). Thus, a contact area with the male terminal (11) is reduced gradually toward the contact portion (25, 28).

14 Claims, 14 Drawing Sheets

(51) Int. Cl.
*H01R 13/11* (2006.01)
*H01R 4/02* (2006.01)
*H01R 4/18* (2006.01)

(58) Field of Classification Search
USPC ..... 439/439
See application file for complete search history.

(56) References Cited

U.S. PATENT DOCUMENTS

| | | | | |
|---|---|---|---|---|
| 2006/0003641 | A1 | 1/2006 | Morikawa | |
| 2007/0072494 | A1 | 3/2007 | Tyler | |
| 2010/0230160 | A1* | 9/2010 | Ono ..... | H01R 4/185<br>174/84 C |

FOREIGN PATENT DOCUMENTS

| | | |
|---|---|---|
| JP | 8-250174 | 9/1996 |
| JP | 11-339874 | 12/1999 |
| JP | 2005-197090 | 7/2005 |
| JP | 2006-344474 | 12/2006 |

* cited by examiner

FEMALE TERMINAL WITH RESILIENT PIECE HAVING A CONTACT SURFACE THAT GRADUALLY NARROWS TO A CONTACT POINT

BACKGROUND

1. Field of the Invention

The present invention relates to a female terminal to be connected to a male terminal.

2. Description of the Related Art

Conventionally, a female terminal fitting to be connected to a mating terminal is known, for example, fromJapanese Unexamined Utility Model Publication No. H06-9069. This female terminal fitting includes a box-shaped electrically connecting portion composed of a base plate, side walls and an upper plate, and a resilient contact piece arranged in this electrically connecting portion. The resilient contact piece is formed into a cantilever-like shape by being folded backward from the front edge of the base plate. Further, the resilient contact piece has a chevron shape when viewed laterally and comes into line contact with the mating terminal at a top of the chevron shape.

However, in the above female terminal fitting, if at least one of the mating terminal and the female terminal fitting is relatively twisted about an axis extending in an inserting direction of the mating terminal into the electrically connecting portion, a contact state between the resilient contact piece and the mating terminal changes from line contact to point contact, whereby a contact area suddenly changes. Accordingly, it is also thought to eliminate a sudden change of the contact area at the time of twisting by forming a contact point of a female terminal fitting 1 with a mating terminal 2 into an embossed part 3 as shown in FIG. 14. However, according to this method, a contact pressure increases when a slant portion 65 of a tip 4 of the mating terminal 2 or an intersection 7 between the slant portion 5 and a horizontal portion 6 moves onto the embossed part 3, thereby increasing an insertion force. Further, in the female terminal fitting 1 in which a plating is formed on a surface of the embossed part 3, a plating base may be exposed and connected to the mating terminal 2, for example, if the mating terminal 2 is repeatedly inserted into and withdrawn from the female terminal fitting 1 such as for maintenance.

SUMMARY

The present invention is a directed to a female terminal with a tubular portion formed into a tubular shape by a plurality of peripheral walls and configured such that a male terminal is to be inserted, and a resilient piece formed to extend inwardly of the tubular portion from the peripheral wall and configured to resiliently come into contact with the male terminal, the resilient piece including a slide-contact portion capable of sliding in line or surface contact with the male terminal, a contact portion configured to come into point contact with the male terminal, and a gradually changing portion formed in an area from an end of the slide-contact portion to a top of the contact portion and not protruding from a plane flush with a contact surface of the slide-contact portion with the male terminal and configured such that a contact area with the male terminal is gradually reduced toward the contact portion.

According to this configuration, the male terminal inserted into the tubular portion advances while sliding in contact with the resilient piece and comes into point contact at the contact portion. Here, in the process of the male terminal reaching the contact portion, the male terminal is in line or surface contact with the gradually changing portion. However, since the contact area of the gradually changing portion with the male terminal is gradually reduced toward the contact portion, a contact state of the resilient piece and the male terminal smoothly transitions from line or surface contact to point contact in the process of inserting the male terminal into the tubular portion. Note that the male terminal inserted into the tubular portion may move onto the gradually changing portion after contacting the slide-contact portion or may directly contact the gradually changing portion without contacting the slide-contact portion.

Since the gradually changing portion is formed in the area not protruding from the plane flush with the contact surface of the slide-contact portion with the male terminal, the tip of the male terminal does not collide with the gradually changing portion from front to increase a contact pressure when the tip of the male terminal moves onto the gradually changing portion from the end of the slide-contact portion. Further, since the gradually changing portion is formed to reach the top of the contact portion, the male terminal does not move onto the contact portion to increase the contact pressure when the tip of the male terminal moves onto the contact portion from the gradually changing portion. Accordingly, a peak value of the contact pressure becomes smaller, whereby an insertion force can be reduced. Further, in a female terminal having a plating formed on a surface of a contact portion, an effect that the plating is difficult to abrade even if the male terminal is repeatedly inserted into and withdrawn from the female terminal such as for maintenance is also obtained if the contact pressure is reduced.

A cutting line cutting the contact surface of the resilient piece with the male terminal in a longitudinal direction at a position passing through the top of the contact portion along an inserting direction of the male terminal may be a straight line. According to this configuration, a ratio of a deflection amount of the resilient piece to an insertion distance of the male terminal can be kept constant. Thus, a sudden change of the contact pressure can be avoided.

The gradually changing portion may come into line contact with the male terminal and a length of a contact edge of the gradually changing portion with the male terminal may become gradually shorter toward the contact portion. According to this configuration, in the process of inserting the male terminal into the tubular portion, the contact state of the resilient piece and the male terminal changes from line contact to point contact. Thus, it can be avoided that the contact area with the male terminal suddenly decreases to suddenly increase the contact pressure.

A contact surface of the male terminal with the gradually changing portion and a contact surface of the gradually changing portion with the male terminal may be both flat surfaces. According to this configuration, the contact surface of the gradually changing portion and the contact surface (e.g. an inclined surface connected to a tip surface of the male terminal or a horizontal surface connected to this inclined surface) of the male terminal contact each other, wherefore the male terminal can be inserted in a stable posture.

A contact edge of the contact portion with the male terminal may be arcuate. According to this configuration, if either one of the male terminal and the female terminal is twisted about an axis extending in the inserting direction of the male terminal into the tubular portion, the male terminal can be held in point contact before, during and after a twisting movement. Note that the point contact of the contact portion with the male terminal means that the position of the contact portion is clarified. Associated with this, a gap control between the contact portion and a part facing this, which is one of control items in manufacturing the female terminal, becomes easier.

The peripheral wall may include a base end portion shaped to be folded inwardly of the tubular portion from a front end edge of the peripheral wall, and the resilient piece may extend backward from the base end portion. According to this configuration, the collision of external matters with the resilient piece is easily avoided. Further, since the base end portion has a higher rigidity than the resilient piece, the base end portion is hard to deform even if an external matter collides with the base end portion. Since this suppresses a displacement of the resilient piece in the tubular portion due to the collision of the external matter, a stable contact pressure can be applied to the male terminal.

The plurality of peripheral walls may include a bottom wall and a ceiling wall arranged to face the bottom wall, and the resilient piece may be composed of a first resilient piece formed on the bottom wall and a second resilient piece formed on the ceiling wall. According to this configuration, the male terminal is sandwiched between the first and second resilient pieces, wherefore an increase of the contact pressure can be avoided by both the first and second resilient pieces.

A plurality of the resilient pieces may be arranged over an entire area of the tubular portion in a direction intersecting with an inserting direction of the male terminal. According to this configuration, the number of contacts with the male terminal increases, wherefore contact resistance with the male terminal can be reduced, which is preferable for a terminal for large current application.

According to the present invention, a male terminal does not move onto a contact portion to increase a contact pressure when the tip of the male terminal moves from a gradually changing portion to the contact portion.

DETAILED DESCRIPTION

Figure 1:
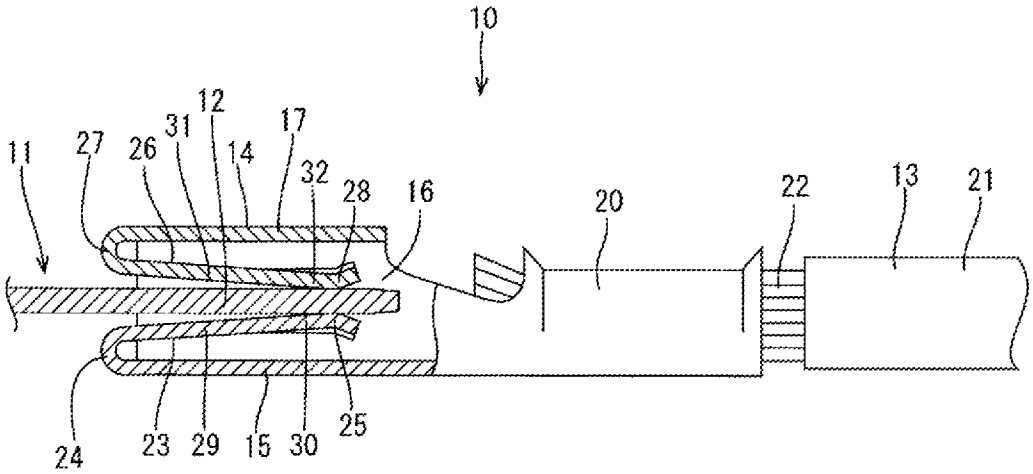
FIG. 1 is a side view partly in section showing a female terminal according to an embodiment of the present invention.

An embodiment of the present invention is described with reference to FIGS. 1 to 13. A female terminal 10 according to this embodiment is electrically connected to a male terminal 11 as shown in FIG. 1. In the following description, left and right sides in FIG. 1 are respectively referred to as front and rear sides. Further, upper and lower sides in FIG. 1 are respectively referred to as upper and lower sides.

(Male Terminal 11)

The male terminal 11 is formed by press-working a metal plate material into a predetermined shape. The male terminal 11 includes a male tab 12 in the form of a long and narrow plate and a contact surface of the male tab 12 with the female terminal 10 is a flat surface. Although the male terminal 11 is connected to an end of a wire 13 in this embodiment, it may be connected to an unillustrated device.

(Female Terminal 10)

Figure 2:
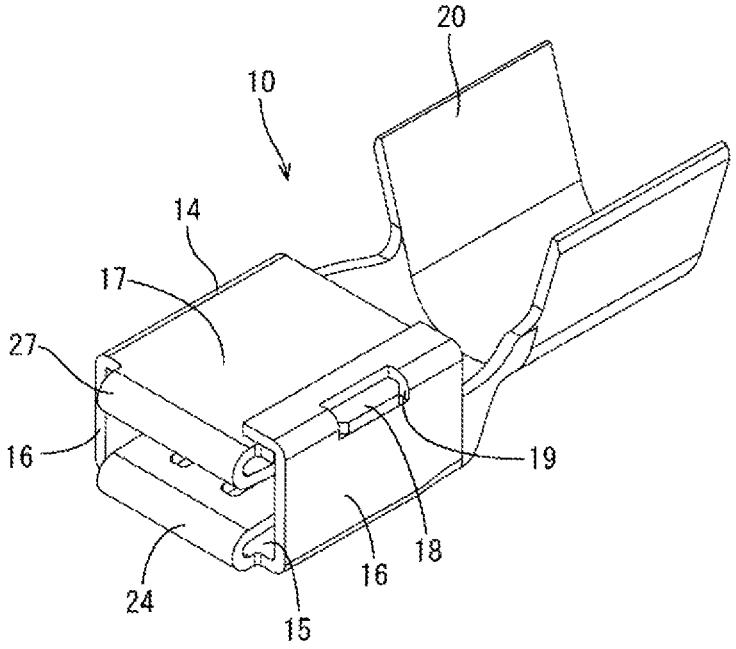
FIG. 2 is a perspective view showing the female terminal.
Figure 3:
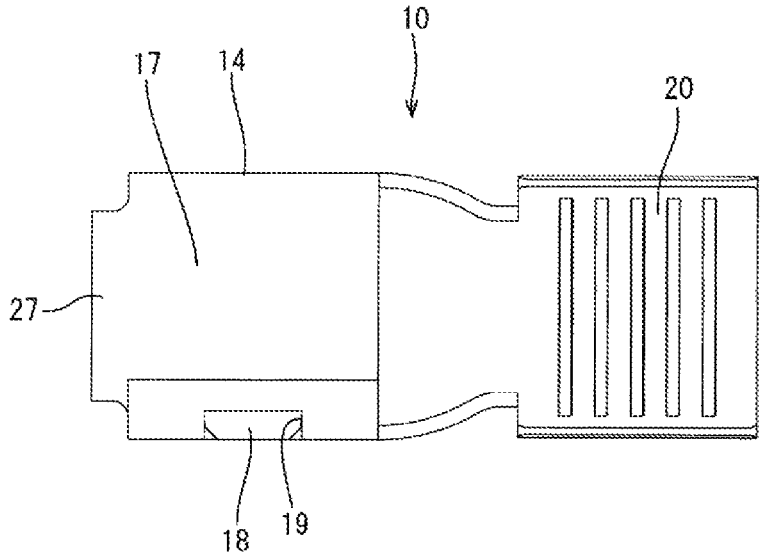
FIG. 3 is a plan view showing the female terminal.
Figure 4:
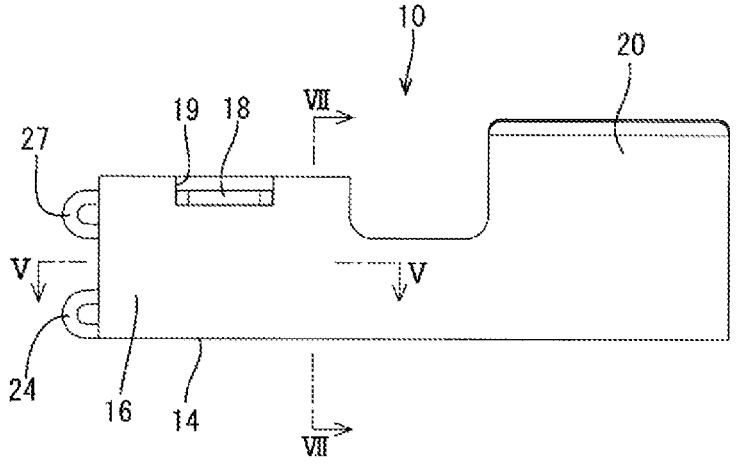
FIG. 4 is a side view showing the female terminal.

The female terminal 10 is formed by press-working a metal plate material into a predetermined shape. The female terminal 10 includes a tubular portion 14 into which the male tab 12 of the male terminal 11 is to be inserted. As shown in FIGS. 2 to 4, the tubular portion 14 is substantially in the form of a rectangular tube open in a front-back direction. A plurality of peripheral walls are configured into the tubular portion 14 in the form of a rectangular tube. These peripheral walls include a bottom wall 15, a pair of side walls 16 standing upwardly from opposite side edges of the bottom wall 15 and a ceiling wall 17 facing the bottom wall 15.

The ceiling wall 17 is bent substantially at a right angle at the upper end edge of one of the pair of side walls 16 and extends toward the other side wall 16. A locking portion 18 is formed to project on a side end edge of the ceiling wall 17 and inserted into a locking hole 19 formed on the other side wall 16. A side end edge of the other side wall 16 is folded onto the upper surface of the ceiling wall 17. In this way, the tubular portion 14 is held in the rectangular tube shape.

A wire barrel 20 extends behind the bottom wall 15. As shown in FIG. 1, a core 22 exposed from an insulation coating 21 at an end of the wire 13 is connected to this wire barrel 20. The wire barrel 20 is swaged and crimped to the core 22.

(First Resilient Piece 23)

A first base end portion 24 is formed to project on the front end edge of the bottom wall 15. The first base end portion 24 is folded inwardly of the tubular portion 14 (backwardly) from the front end edge of the bottom wall 15. As shown in FIG. 4, the first base end portion 24 projects slightly forwardly from the front end edge of the tubular portion 14.

Figure 5:
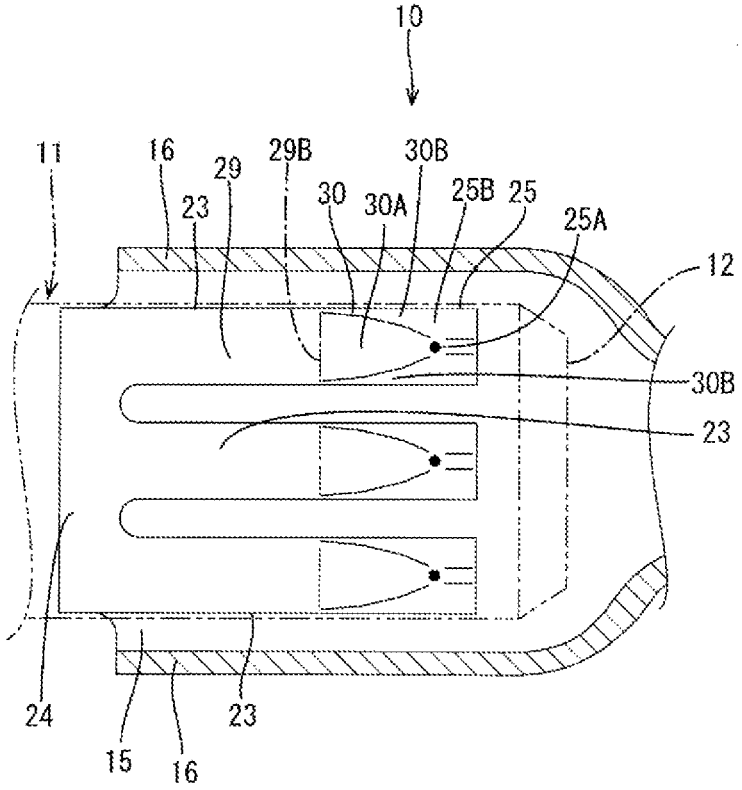
FIG. 5 is a section along V-V of FIG. 4.
Figure 12:
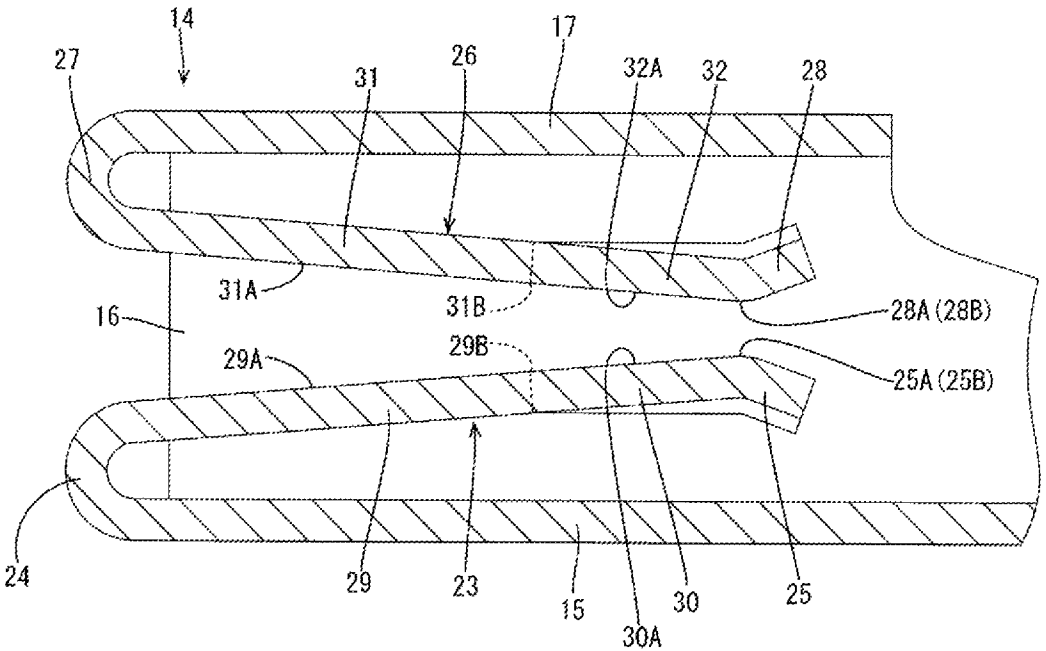
FIG. 12 is a section showing contact surfaces of the resilient pieces with the male terminal cut in a longitudinal direction at a position passing through tops of contact portions along an inserting direction of the male terminal.
Figure 13:
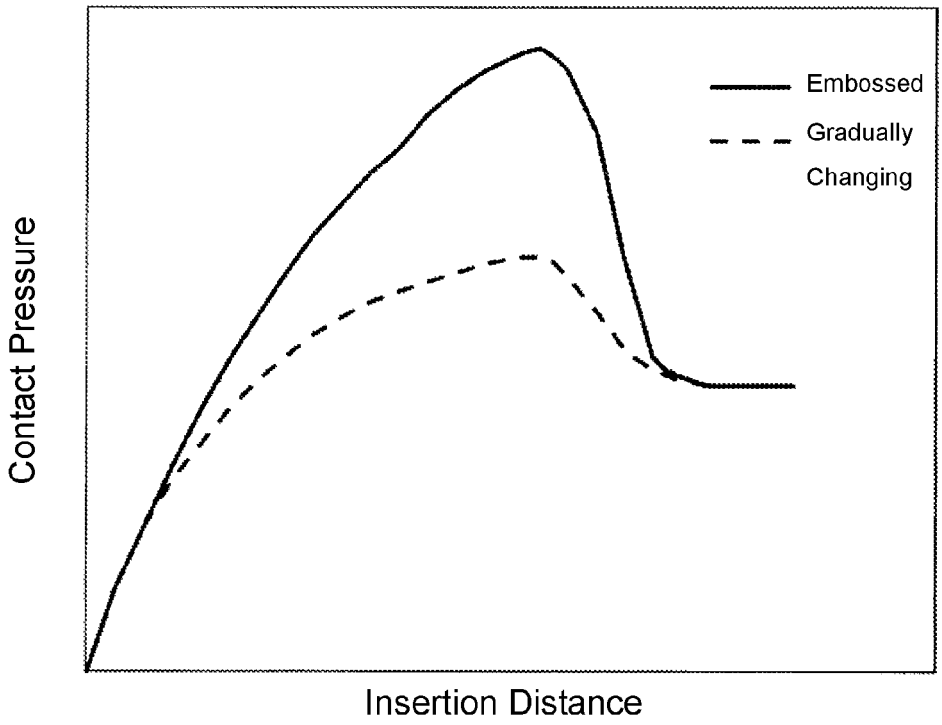
FIG. 13 is a graph showing a relationship of an insertion distance and a contact pressure.

As shown in FIG. 5, a plurality of (three in this embodiment) first resilient pieces 23 arranged side by side while being spaced apart in a direction intersecting with an inserting direction of the male terminal 11 are formed to extend inwardly of the tubular portion 14 (backwardly) on the rear end edge of the folded first base end portion 24. As shown in FIG. 12, the first resilient piece 23 extends straight in a cantilever manner from the first base end portion 24 when viewed laterally. A first contact portion 25 is formed on an extending end part of this first resilient piece 23, and resiliently contacts the male terminal 11. For example, silver plating is applied to the first contact portion 25.

The respective first resilient pieces 23 are formed to have a substantially equal length in the front-back direction. Further, the respective first resilient pieces 23 are formed to have a substantially equal width in a direction perpendicular to the inserting direction of the male terminal 11 (hereinafter, referred to as a "width direction"). Further, intervals between adjacent resilient pieces 23 are both substantially equal. Thus, the plurality of first resilient pieces 23 are arranged substantially over the entire area of the tubular portion 14 in the width direction while being equally spaced apart.

Figure 6:
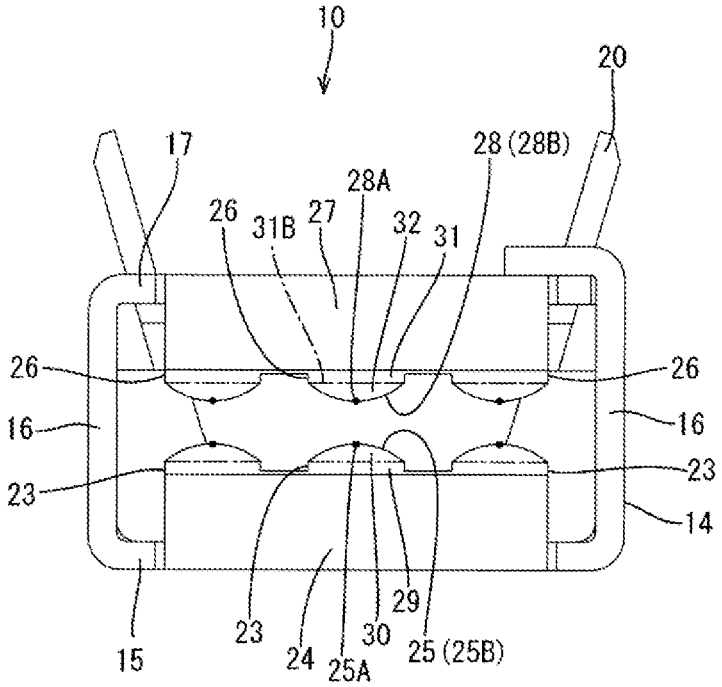
FIG. 6 is a front view showing the female terminal.
Figure 7:
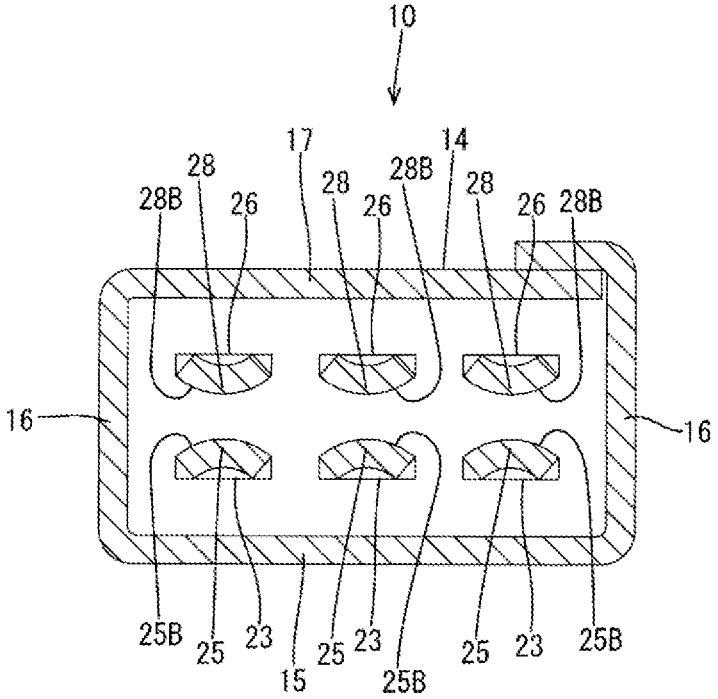
FIG. 7 is a section showing only a cut position along VII-VII of FIG. 4.
Figure 8:
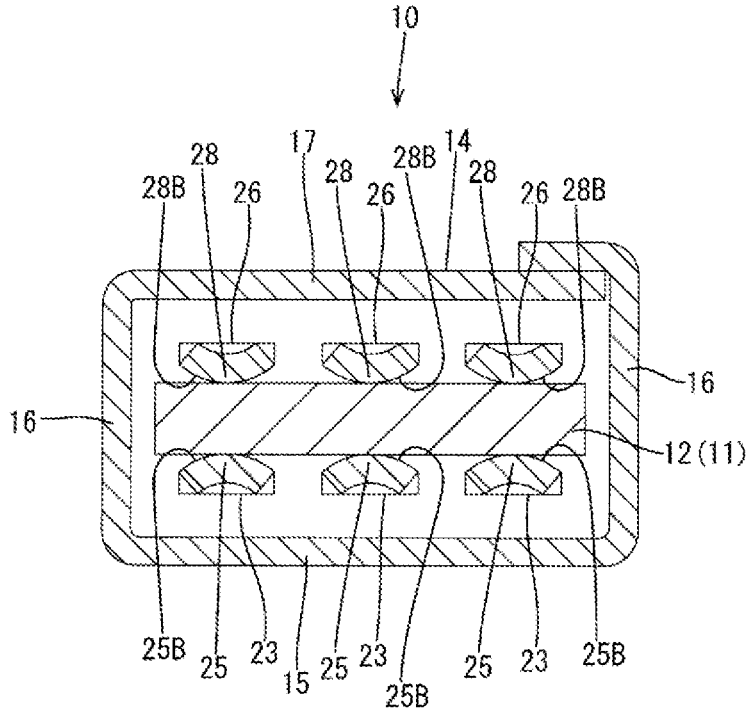
FIG. 8 is a section showing the same cut position as in FIG. 7 and showing a properly connected state of a male terminal and the female terminal.

As shown in FIG. 7, a contact edge 25B of the first contact portion 25 with the male terminal 11 is arc-like. As shown in FIG. 6, one first contact portion 25 is formed on each first resilient piece 23. Further, as shown in FIG. 7, the first contact portion 25 is formed over the entire width of the first resilient piece 23. This causes the contact edge 25B of the first contact portion 25 to be held in point contact with the male terminal 11 in a wide range in response to a twisting movement of the male terminal 11, and a contact state does not suddenly change due to the twisting movement of the male terminal 11.

(Second Resilient Piece 26)

A second base end portion 27 is formed to project on the front end edge of the ceiling wall 17. The second base end portion 27 is folded inwardly (backwardly) of the tubular portion 14 from the front end edge of the ceiling wall 17. As shown in FIG. 4, the second base end portion 27 projects slightly forwardly from the front end edge of the tubular portion 14.

As shown in FIG. 5, a plurality of (three in this embodiment) second resilient pieces 26 arranged side by side while being spaced apart in the direction intersecting with the inserting direction of the male terminal 11 are formed to extend inwardly (backwardly) of the tubular portion 14 on the rear end edge of the folded second base end portion 27. As shown in FIG. 12, the second resilient piece 26 extends straight in a cantilever manner from the second base end portion 27 when viewed laterally. A second contact portion 28 is formed on an extending end part of this second resilient piece 26, and resiliently contacts the male terminal 11. For example, silver plating is applied to the second contact portion 28.

The respective second resilient pieces 26 are formed to have a substantially equal length in the front-back direction. Further, the respective second resilient pieces 26 are formed to have a substantially equal width in a direction perpendicular to the inserting direction of the male terminal 11 (hereinafter, referred to as a "width direction"). Further, intervals between adjacent resilient pieces 26 are both substantially equal. Thus, the plurality of second resilient pieces 26 are arranged substantially over the entire area of the tubular portion 14 in the width direction while being equally spaced apart.

As shown in FIG. 7, a contact edge 28B of the second contact portion 28 with the male terminal 11 is arc-like. As shown in FIG. 6, one second contact portion 28 is formed on each second resilient piece 26. Further, as shown in FIG. 7, the second contact portion 28 is formed over the entire width of the second resilient piece 26. This causes the contact edge 28B of the second contact portion 28 to be held in point contact with the male terminal 11 in a wide range in response to a turning movement of the male terminal 11, and a contact state does not suddenly change due to the twisting movement of the male terminal 11.

As shown in FIG. 6, the first base end portion 24 and the first resilient pieces 23, the second base end portion 27 and the second resilient pieces 26 are vertically symmetrically formed. In this way, the first contact portions 25 of the first resilient pieces 23 and the second contact portions 28 of the second resilient pieces 26 are respectively arranged to face each other (see FIG. 7).

(First Line Contact Portions and First Gradually Changing Portions)

As shown in FIG. 12, the first resilient piece 23 includes a first line-contact portion 29 configured to come into line contact with the male terminal 11, the first contact portion 25 configured to come into point contact with the male terminal 11 and a first gradually changing portion 30 arranged between these and configured such that a contact area with the male terminal 11 is gradually reduced toward the first contact portion 25. As shown in FIG. 5, the first gradually changing portion 30 has a substantially isosceles triangular shape long in the front-back direction and is formed in an area from an end 29B of the first line-contact portion 29 to a top 25A of the first contact portion 25. A cutting line cutting contact surfaces 29A, 30A of the first resilient piece 23 with the male terminal 11 in a longitudinal direction at a position passing through the top 25A of the first contact portion 25 along the inserting direction of the male terminal 11 is a straight line (see FIG. 12). Specifically, the first gradually changing portion 30 is formed in an area not protruding from a plane flush with the contact surface 29A of the first line-contact portion 29 (this plane and an area below it). Particularly, in this embodiment, the contact surface 29A of the first line-contact portion 29, the contact surface 30A of the first gradually changing portion 30 and the top 25A of the first contact portion 25 are arranged side by side in this order along a straight line.

Figure 10:
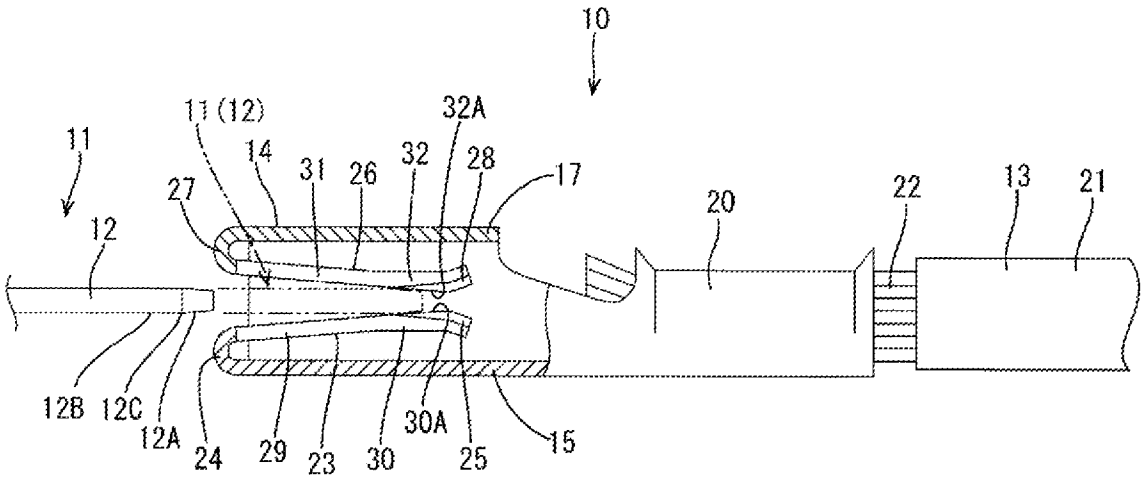
FIG. 10 is a side view partly in section showing a state while the male terminal is being inserted into the female terminal.
Figure 11:
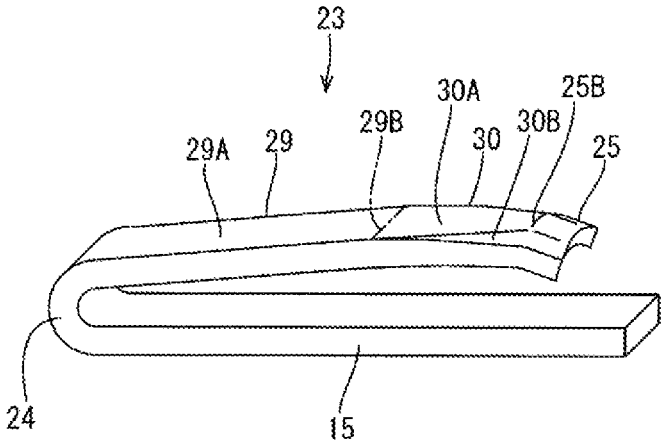
FIG. 11 is a perspective view showing a resilient piece.

Both the contact surface 29A of the first line-contact portion 29 and the contact surface 30A of the first gradually changing portion 30 are flat surfaces and configured to come into line contact with the male terminal 11. A length of a contact edge with the male terminal 11 on the contact surface 29A of the first line-contact portion 29 is constant in the inserting direction of the male terminal 11, whereas a length of a contact edge with the male terminal 11 on the contact surface 30A of the first gradually changing portion 30 is longest at the end 29B of the first line-contact portion 29, becomes gradually shorter toward the first contact portion 25 and is shortest at the first contact portion 25. As shown in FIGS. 10 and 11, first non-contact surfaces 30B configured not to contact the male terminal 11 are formed at opposite sides of the first gradually changing portion 30 and connected to the contact edge 25B of the first contact portion 25. Note that the first contact portion 25 extends obliquely downward while maintaining a cross-sectional shape at the contact edge 25B.

(Second Line Contact Portions and Second Gradually Changing Portions)

As shown in FIG. 12, the second resilient piece 26 includes a second line-contact portion 31 configured to come into line contact with the male terminal 11, the second contact portion 28 configured to come into point contact with the male terminal 11 and a second gradually changing portion 32 arranged between these and configured such that a contact area with the male terminal 11 is gradually reduced toward the second contact portion 28. Similarly to the first gradually changing portion 30, the second gradually changing portion 32 has a substantially isosceles triangular shape long in the front-back direction and is formed in an area from an end 31 B of the second line-contact portion 31 to a top 28A of the second contact portion 28. A cutting line cutting contact surfaces 31A, 32A of the second resilient piece 26 with the male terminal 11 in the longitudinal direction at a position passing through the top 28A of the second contact portion 28 along the inserting direction of the male terminal 11 is a straight line (see FIG. 12). Specifically, the second gradually changing portion 32 is formed in an area not protruding from a plane flush with the contact surface 31A of the second line-contact portion 31 (this plane and an area above it). Particularly, in this embodiment, the contact surface 31A of the second line-contact portion 31, the contact surface 32A of the second gradually changing portion 32 and the top 28A of the second contact portion 28 are arranged side by side in this order along a straight line.

Both the contact surface 31 A of the second line-contact portion 31 and the contact surface 32A of the second gradually changing portion 32 are flat surfaces and configured to come into line contact with the male terminal 11. A length of a contact edge with the male terminal 11 on the contact surface 31A of the second line-contact portion 31 is constant in the inserting direction of the male terminal 11, whereas a length of a contact edge with the male terminal 11 on the contact surface 32A of the second gradually changing portion 32 is longest at the end 31 B of the second line-contact portion 31, becomes gradually shorter toward the second contact portion 28 and is shortest at the second contact portion 28. As shown in FIG. 10, second non-contact surfaces 32B configured not to contact the male terminal 11 are formed at opposite sides of the second gradually changing portion 32 and connected to the contact edge 28B of the second contact portion 28. Note that the second contact portion 28 extends obliquely upward while maintaining a cross-sectional shape at the contact edge 28B.

(Functions and Effects of Embodiment)

Next, functions and effects of this embodiment are described. When the male terminal 11 shown by solid line of FIG. 10 is inserted into the tubular portion 14, it advances between the first and second resilient pieces 23 and 26. Then, the male terminal 11 comes into contact with the contact surfaces 30A of the first gradually changing portions 30 and the contact surfaces 32A of the second gradually changing portions 32 as shown by chain double-dashed line of FIG. 10. From this state, the male terminal 11 thrusts itself between the respective resilient pieces 23 and 26 while sliding in contact with the respective contact surfaces, whereby the first resilient pieces 23 are resiliently deformed downwardly and the second resilient pieces 26 are resiliently deformed upwardly.

When advancing further backward in the tubular portion 14, the male terminal 11 is inserted between the tops 25A of the first contact portions 25 and the tops 28A of the second contact portions 28 as shown in FIG. 1. By being pressed by resilient forces of the first resilient pieces 23, the male terminal 11 is pressed against the second contact portions 28 with a proper contact pressure. On the other hand, by being pressed by resilient forces of the second resilient pieces 26, the male terminal 11 is pressed against the first contact portions 25 with a proper contact pressure. In this way, the male terminal 11 and the female terminal 10 are electrically connected.

Figure 14:
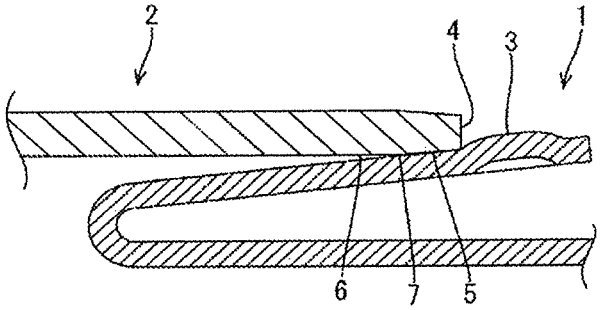
FIG. 14 PRIOR ART
FIG. 14 is a section showing a state where a mating terminal is moved onto an embossed part.

In the process of inserting the male terminal 11 into the tubular portion 14, a slant portion 12A at the tip of the male terminal 11 or an intersection 12C of the slant portion 12A and a horizontal portion 12B does not collide with each contact portion 25, 28 of each resilient piece 23, 26 from front as shown in FIG. 10. Thus, as shown by a broken line of FIG. 13, a peak value of the contact pressure can be drastically reduced as compared to the female terminal fitting 1 having the embossed part 3 (see FIG. 14). On the other hand, in the female terminal fitting 1 having the embossed part 3, the tip of the mating terminal 2 collides with the embossed part 2 from front. Thus, as shown by a solid line of FIG. 13, a peak value of the contact pressure is larger than in this embodiment. Therefore, according to the female terminal 10 of this embodiment, an insertion force of the male terminal 11 can be drastically reduced with a reduction of the contact pressure and the abrasion of the silver platings formed on the surfaces of the respective contact portions 25, 28 can be suppressed.

Figure 9:
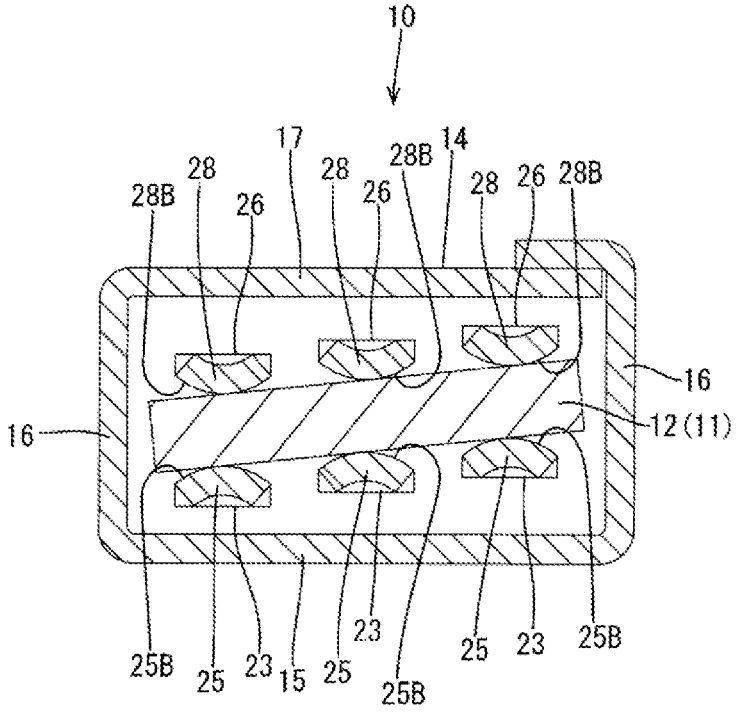
FIG. 9 is a section showing the same cut position as in FIG. 7 and showing a state where the male terminal is twisted.

FIG. 9 shows a state where the male terminal 11 is twisted about an axis extending in the inserting direction of the male terminal 11 into the tubular portion 14. When the male terminal 11 is twisted counterclockwise from a properly inserted state shown in FIG. 8, contact positions of the male terminal 11 and the respective contact portions 25, 28 reach positions shown in FIG. 9 while slightly moving counterclockwise along the contact edges 25B, 28B of the respective contact portions 25, 28 from the respective tops 25A, 28A. Thus, it can be avoided that the contact of the male terminal 11 concentrates on one of the respective contact portions 25, 28.

Further, since the male terminal 11 is held in a similar point contact state with each contact portion 25, 28 before and after the twisting movement, a contact state of the male terminal 11 and each contact portion 25, 28 does not suddenly change and a sufficient contact pressure is ensued at any of the contact positions.

As described above, in this embodiment, the male terminal 11 inserted into the tubular portion 14 advances while sliding in contact with each resilient piece 23, 26 and comes into point contact at each contact portion 25, 28. Here, in the process of the male terminal 11 reaching each contact portion 25, 28, the male terminal 11 is in line contact or surface contact with each gradually changing portion 30, 32. However, since the contact area of each gradually changing portion 30, 32 with the male terminal 11 is gradually reduced toward each contact portion 25, 28, a contact state of each resilient piece 23, 26 and the male terminal 11 smoothly transitions from line or surface contact to point contact in the process of inserting the male terminal 11 into the tubular portion 14. Note that the male terminal 11 inserted into the tubular portion 14 may move onto each gradually changing portion 30, 32 after contacting each line-contact portion 29, 31 or may directly contact each gradually changing portion 30, 32 without contacting each line-contact portion 29, 31.

Since each gradually changing portion 30, 32 is formed in the area not protruding from the plane flush with the contact surface 29A, 31A of each line-contact portion 29, 31 with the male terminal 11, the slant portion 12A at the tip of the male terminal 11 or the intersection 12C of the slant portion 12A and the horizontal portion 12B does not move onto each gradually changing portion 30, 32 to increase the contact pressure when the tip of the male terminal 11 moves onto each gradually changing portion 30, 32 from the end 29B, 31B of each line-contact portion 29, 31. Further, since each gradually changing portion 30, 32 is formed to reach the top 25A, 28A of each contact portion 25, 28, the slant portion 12A at the tip of the male terminal 11 or the intersection 12C of the slant portion 12A and the horizontal portion 12B does not move onto each contact portion 25, 28 to increase the contact pressure when the tip of the male terminal 11 moves onto each contact portion 25, 28 from each gradually changing portion 30, 32. Accordingly, the peak value of the contact pressure becomes smaller, whereby the insertion force can be reduced. Further, in the female terminal 10 having the silver plating formed on the surface of each contact portion 25, 28 as in this embodiment, an effect that the silver plating is difficult to abrade even if the male terminal 11 is repeatedly inserted into and withdrawn from the female terminal 10 such as for maintenance is also obtained if the contact pressure is reduced.

The cutting line cutting the contact surfaces 29A, 30A, 31A and 32A of the respective resilient pieces 23, 26 with the male terminal 11 in the longitudinal direction at the position passing through the tops 25A, 28A of the respective contact portions 25, 28 along the inserting direction of the male terminal 11 may be a straight line.

According to this configuration, a ratio of a deflection amount of each resilient piece 23, 26 to an insertion distance of the male terminal 11 can be kept constant. Thus, a sudden change of the contact pressure can be avoided.

Each gradually changing portions 30, 32 may come into line contact with the male terminal 11 and the length of the contact edge of each gradually changing portion 30, 32 with the male terminal 11 may become gradually shorter toward each contact portion 25, 28.

According to this configuration, in the process of inserting the male terminal 11 into the tubular portion 14, the state of each resilient piece 23, 26 and the male terminal 11 changes from line contact to point contact. Thus, it can be avoided that the contact area with the male terminal 11 suddenly decreases to suddenly increase the contact pressure.

A contact surface (male tab 12) of the male terminal 11 with each gradually changing portion 30, 32 and the contact surface 30A, 32A of each gradually changing portion 30, 32 with the male terminal 11 may be both flat surfaces.

According to this configuration, the contact surface 30A, 32A of each gradually changing portion 30, 32 and the contact surface (male tab 12) of the male terminal 11 contact each other, wherefore the male terminal 11 can be inserted in a stable posture.

The contact edge 25B, 28B of each contact portion 25, 28 with the male terminal 11 may be arcuate.

According to this configuration, if either one of the male terminal 11 and the female terminal 10 is twisted about the axis extending in the inserting direction of the male terminal 11 into the tubular portion 14, the male terminal 11 can be held in point contact before, during and after a twisting movement. Note that the point contact of each contact portion 25, 28 with the male terminal 11 means that the position of each contact portion 25, 28 is clarified. Associated with this, a gap control between each contact portion 25, 28 and a part facing this (between the respective contact portions 25 and 28 in this embodiment), which is one of control items in manufacturing the female terminal 10, becomes easier.

The peripheral walls (bottom wall 15, ceiling wall 17) may include each base end portion 24, 27 folded inwardly of the tubular portion 14 from the front end edge of the peripheral wall and each resilient piece 23, 26 may extend backward from each base end portion 24, 27.

According to this configuration, the collision of external matters with each resilient piece 23, 26 is easily avoided. Further, since each base end portion 24, 27 has a higher rigidity than each resilient piece 23, 26, each base end portion 24, 27 is hard to deform even if an external matter collides with each base end portion 24, 27. Since this suppresses a displacement of each resilient piece 23, 26 in the tubular portion 14 due to the collision of the external matter, a stable contact pressure can be applied to the male terminal 11.

The plurality of peripheral walls may include the bottom wall 15 and the ceiling wall 17 arranged to face this bottom wall 15, and the resilient piece may be composed of the first resilient piece 23 formed on the bottom wall 15 and the second resilient piece 26 formed on the ceiling wall 17.

According to this configuration, the male terminal 11 is sandwiched between the first and second resilient pieces 23, 26, wherefore an increase of the contact pressure can be avoided by both the first and second resilient pieces 23, 26.

A plurality of resilient pieces 23 and a plurality of resilient pieces 26 may be arranged over the entire area of the tubular portion 14 in the direction intersecting with the inserting direction of the male terminal 11.

According to this configuration, the number of contacts with the male terminal 11 increases, wherefore contact resistance with the male terminal 11 can be reduced, which is preferable for a terminal for large current application.

The present invention is not limited to the above described and illustrated embodiment. For example, the following embodiments are also included in the technical scope of the present invention.

Although the core 22 of the wire 13 is crimped and connected to the wire barrel 20 in the above embodiment, resistance welding, ultrasonic welding, soldering or the like may be used as a connection method of the core 22 and the female terminal 10 according to the present invention.

Although the male terminal 11 is sandwiched between the resilient pieces 23, 26 arranged to vertically face each other in the above embodiment, a resilient piece may be provided on either one side and the male terminal 11 may be sandwiched between this resilient piece and the peripheral wall facing this according to the present invention. Further, although the plurality of resilient pieces are arranged side by side in the direction intersecting with the inserting direction of the male terminal 11 in the above embodiment, only one resilient piece may be provided in the direction intersecting with the inserting direction of the male terminal 11 according to the present invention.

Although each resilient piece 23, 26 is formed to extend backward from each base end portion 24, 27 in the above embodiment, each resilient piece may be formed to extend forward from a rear end part of the tubular portion 14 according to the present invention.

Although each gradually changing portion 30, 32 is formed to be flush with the plane flush with the contact surface 29A, 31A of each line-contact portion 29, 31 with the male terminal 11 in the above embodiment, the first gradually changing portion may be formed below the plane flush with the contact surface 29A of the first line-contact portion 29 and the second gradually changing portion may be formed above the plane flush with the contact surface 31A of the second line-contact portion 31 according to the present invention.

Although the male terminal 11 in the form of a flat plate is illustrated in the above embodiment, a male terminal in the form of a round bar may be adopted according to the present invention. In this case, a resilient piece of a female terminal may be formed into a cylindrical shape.

Although the length of the contact edge of each gradually changing portion 30, 32 with the male terminal 11 becomes gradually shorter toward each contact portion 25, 28 in the above embodiment, a section extending toward each contact portion 25, 28 while having the constant length of the contact edge with the male terminal 11 may be provided in a part of each gradually changing portion according to the present invention.

Although the contact edge 25B, 28B of each contact portion 25, 28 is arc-like in the above embodiment, the contact edge of each contact portion has only to be arcuate and may have a shape other than an arc-like shape according to the present invention.

Although the respective resilient pieces 23, 26 are formed on the bottom wall 15 and the ceiling wall 17 of the tubular portion 14 in the above embodiment, resilient pieces may be formed on the side walls 16 according to the present invention.

Although each resilient piece 23, 26 is formed on each base end portion 24, 27 after the base end portions 24, 27 are formed on the bottom wall 15 and the ceiling wall 17 in the above embodiment, each resilient piece may be directly formed on the bottom wall 15 and the ceiling wall 17 without providing any base end portion according to the present invention.

Although the first and second line-contact portions 29, 31 are illustrated as slide-contact portions in the above embodiment, surface-contact portions configured to come into surface contact with the male terminal 11 may be adopted as the slide-contact portions according to the present invention.

LIST OF REFERENCE SIGNS

10 . . . female terminal
11 . . . male terminal
12 . . . male tab (contact surface)
14 . . . tubular portion
15 . . . bottom wall (peripheral wall)
17 . . . ceiling wall (peripheral wall)
23 . . . first resilient piece
24 . . . first base end portion
25 . . . first contact portion
25A . . . top
25B . . . contact edge
26 . . . second resilient piece
27 . . . second base end portion
28 . . . second contact portion
28A . . . top
28B . . . contact edge
29 . . . first line-contact portion (slide-contact portion)
29A . . . contact surface
29B . . . end
30 . . . first gradually changing portion
30A . . . contact surface
30B . . . non-contact surface
31 . . . second line-contact portion (slide-contact portion)
31A . . . contact surface
31B . . . end
32 . . . second gradually changing portion
32A . . . contact surface
32B . . . non-contact surface

The invention claimed is:

1. A female terminal, comprising:

a tubular portion formed into a tubular shape by a plurality of peripheral walls and configured such that a male terminal is to be inserted; and a resilient piece formed to extend inwardly of the tubular portion from the peripheral wall and configured to resiliently come into contact with the male terminal, resilient piece including:

a slide-contact portion capable of sliding in line or surface contact with the male terminal;

a contact portion configured to come into point contact with the male terminal; and a gradually changing portion formed in an area from an end of the slide-contact portion to a top of the contact portion and not protruding from a plane flush with a contact surface of the slide-contact portion with the male terminal and configured such that a contact area with the male terminal is gradually reduced toward the contact portion.

2. The female terminal of claim 1, wherein a cutting line cutting the contact surface of the resilient piece with the male terminal in a longitudinal direction at a position passing through the top of the contact portion along an inserting direction of the male terminal is a straight line.

3. The female terminal of claim 2, wherein the gradually changing portion comes into line contact with the male terminal and a length of a contact edge of the gradually changing portion with the male terminal becomes gradually shorter toward the contact portion.

4. The female terminal of claim 3, wherein a contact surface of the male terminal with the gradually changing portion and a contact surface of the gradually changing portion with the male terminal are both flat surfaces.

5. The female terminal of claim 4, wherein a contact edge of the contact portion with the male terminal is arcuate.

6. The female terminal of claim 5, wherein:

the peripheral wall includes a base end portion shaped to be folded inwardly of the tubular portion from a front end edge of the peripheral wall; and the resilient piece extends backward from the base end portion.

7. The female terminal of claim 6, wherein the plurality of peripheral walls include a bottom wall and a ceiling wall arranged to face the bottom wall, and wherein the resilient piece is formed on the bottom wall and the female terminal further comprising a second resilient piece formed on the ceiling wall.

8. The female terminal of claim 7, wherein a plurality of the resilient pieces are arranged over an entire area of the tubular portion in a direction intersecting with an inserting direction of the male terminal.

9. The female terminal of claim 1, wherein the gradually changing portion comes into line contact with the male terminal and a length of a contact edge of the gradually changing portion with the male terminal becomes gradually shorter toward the contact portion.

10. The female terminal of claim 1, wherein a contact surface of the male terminal with the gradually changing portion and a contact surface of the gradually changing portion with the male terminal are both flat surfaces.

11. The female terminal of claim 1, wherein a contact edge of the contact portion with the male terminal is arcuate.

12. The female terminal of claim 1, wherein:

the peripheral wall includes a base end portion shaped to be folded inwardly of the tubular portion from a front end edge of the peripheral wall; and the resilient piece extends backward from the base end portion.

13. The female terminal of claim 1, wherein the plurality of peripheral walls include a bottom wall and a ceiling wall arranged to face the bottom wall, and wherein the resilient piece is formed on the bottom wall and the female terminal further comprising a second resilient piece formed on the ceiling wall.

14. The female terminal of claim 1, wherein the resilient piece comprises plural resilient pieces arranged over an entire area of the tubular portion in a direction intersecting with an inserting direction of the male terminal.

* * * * *